US005884567A

United States Patent [19]

Bartz, Jr.

[11] Patent Number: 5,884,567

[45] Date of Patent: Mar. 23, 1999

[54] ADJUSTABLE SHELVING ASSEMBLY

[75] Inventor: William L. Bartz, Jr., Dover, Del.

[73] Assignee: Metal Masters Foodservice Equipment Co., Inc., Clayton, Del.

[21] Appl. No.: 923,441

[22] Filed: Sep. 4, 1997

[51] Int. Cl.[6] ..... A47B 9/00

[52] U.S. Cl. ..... 108/106; 108/192

[58] Field of Search ..... 108/106, 107, 108/192, 193, 180, 144.1

[56] References Cited

U.S. PATENT DOCUMENTS

| | | | |
|---|---|---|---|
| 3,628,762 | 12/1971 | Williams | 108/107 X |
| 4,318,352 | 3/1982 | Friedman et al. | 108/107 |
| 4,527,490 | 7/1985 | Tipton et al. | 108/192 |
| 4,706,576 | 11/1987 | James | 108/192 |
| 4,750,626 | 6/1988 | Nicely | 108/192 X |
| 5,601,038 | 2/1997 | Welch et al. | 108/193 |

*Primary Examiner*—Jose V. Chen
*Attorney, Agent, or Firm*—Connolly & Hutz

[57] ABSTRACT

Split collars function to releasably attach shelving to a plurality of vertical support posts. Each collar comprises a front half and a rear half with interlocking structure between the collar halves for releasably locking them together. Each split collar has a frusto-conical interior surface, and an upwardly extending shelf supporting hook is integral with one of the collar halves. When the split collars are attached to the support posts the hooks engage and support the shelving, Such shelving may be mounted horizontally or angularly, if desired.

7 Claims, 3 Drawing Sheets

ADJUSTABLE SHELVING ASSEMBLY

BACKGROUND OF THE INVENTION

The present invention relates to an adjustable shelving assembly, and more particularly to an assembly that may include horizontally and/or angularly mounted shelving without the need for dismantling the overall assembly when additional shelving is desired.

Prior to the present invention numerous adjustable shelving systems have been proposed. In many of these systems adjustment of the shelving by adding or removing individual shelves thereof required total dismantling and reconstruction of the shelving. This disadvantage is the result of unitary comer collars on the shelving. A relatively simple and economical procedure has long been sought for the removal and/or addition of shelving without the need for total dismantling the shelving assembly.

SUMMARY OF THE INVENTION

Accordingly, the present invention provides for the addition and/or removal of particular shelving from a shelving assembly without dismantling the assembly.

Another object of the present invention is to provide an adjustable shelving assembly with removable split collars that function to support the shelving to a plurality of vertical support posts.

Still another object of the present invention is an overall adjustable shelving assembly which is user friendly and which enables shelving to be horizontally and/or angularly mounted.

In accordance with the present invention, a split collar is used to releasably attach shelving to a plurality of vertical support posts. Each split collar has a front half and a rear half with interlocking structure between the collar halves for releasably locking the collar halves together. Each collar has a frusto-conical interior surface which is complementary to the exterior frusto-conical surface of a split sleeve releasably attached to one of the vertical support posts. The mating of these frusto-conical surfaces secures the split collar to the split sleeve. Moreover, since the split sleeve is releasably mounted to one of the vertical support posts, the collar is thereby releasably secured to that posts via the split sleeve. An upwardly extending self supporting hook is integral with one of the collar halves of each split collar. These hooks engage and support the shelving added to the assembly.

Preferably the interlocking structure between the collar halves includes undercut grooves on one half and complementary tongues on the other half The undercut grooves may be on the front collar half with the complementary tongues on the rear collar halves. The hook of each split collar is integral with the rear collar half.

Each split collar is utilized with a vertical support post; and an interlocking split sleeve is positioned between the collar and the post. The split sleeve has an interior surface releasably connected to the support posts and an external frusto-conical surface complementary to the interior frusto-conical surface of the split collar.

BRIEF DESCRIPTION OF THE DRAWINGS

Novel feature and advantages of the present invention in addition to those discussed above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
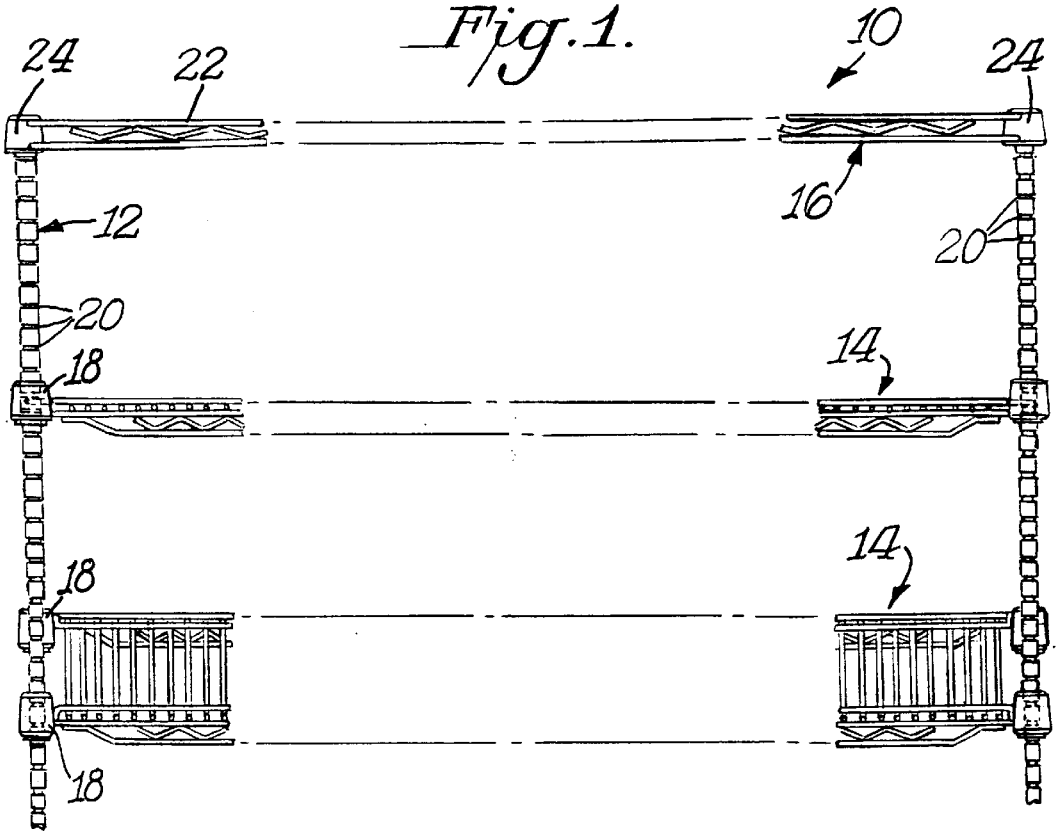
FIG. 1 is a front elevational view illustrating the upper portion of an adjustable shelving assembly including horizontally and angularly mounted shelves, according to the present invention.
Figure 2:
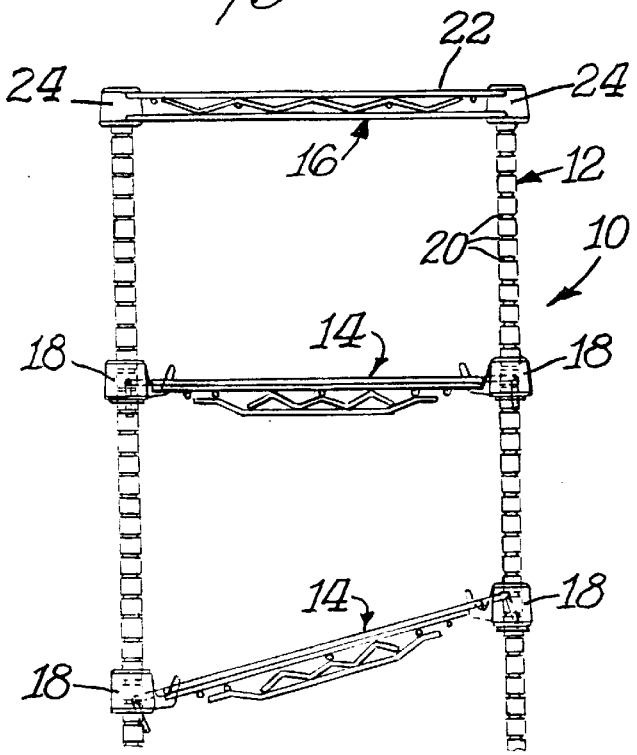
FIG. 2 is a side elevational view of the adjustable shelving assembly shown in FIG. 1.
Figure 3:
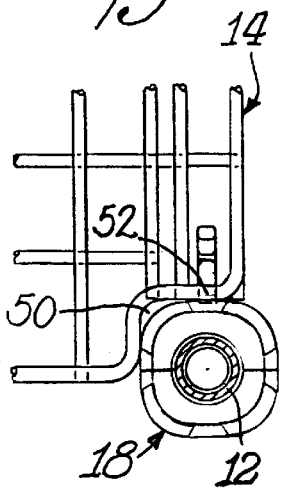
FIG. 3 is a fragmental top plan view of one of the corners of the shelving assembly showing one of the split collars for supporting the shelves relative to the corner support posts.

Referring in more particularity to the drawings, FIGS. 1 and 2 illustrate an adjustable shelving assembly 10, according to the present invention. In one of its forms, the assembly includes four corner support posts 12 and a plurality of shelves 14, 16 releasably mounted to the posts. Shelves 14 releasably mounted by separate and individual split collars 18, one split collar associated with each post for each shelf. Shelves 16 are releasably mounted to the posts in a conventional manner, as described more filly below.

The support posts 12 include a plurality of spaced apart horizontal annular grooves 20 that cooperate with the split collars 18 to mount shelving 14. The exterior surface of each post is cylindrical, and support posts of this configuration are old in the art.

Shelves 16 also are old in art, and each shelf simply comprises a top surface 22 with an integral collar 24 at each corner thereof, The interior surface of each collar 24 is frusto-conical. A split sleeve having a cylindrical interior surface and a frusto-conical exterior is utilized to mount each collar 24 to the support posts. Each split sleeve has an annular projection on its interior surface that engages one of the grooves 20 in the support posts to thereby anchor the split sleeve to the support post. The four integral collars 24 of shelving 16 are fitted over and onto the split sleeves to thereby secure shelving 16 to the split sleeves and support posts. The mating frusto-conical surfaces of the collars 24 and the split sleeves function to anchor the collar to the sleeve, and also to maintain the locking engagement between the interior annular projection of the sleeve and a selected annular groove of its associate support post.

Assembly and disassembly of shelving 16 is time consuming, particularly when an additional shelf is desired in the overall assembly. However, with the shelving 14 and split collars 18, it is not necessary to disassemble the shelves 16 when installing one or more additional shelves 14.

Each split collar 18 has a Front half 26 and a rear half 28 releasably connected together by interlocking structure 30 at the interface between the collar halves. The interior surface 32 of the split collar 18 is frusto-conical in configuration. This interior frusto-conical surface engages the frusto-conical exterior surface 33 of a split sleeve 34 to releasably lock the assembled split collar 18 to one of the support posts 12 in the same manner as described above in connection with the shelving 16 and collars 24. The split sleeve 34 has a cylindrical interior surface 36 with an annular projection 38 that engages one of the grooves 20 when the split sleeves are mounted to the posts. The split sleeves are the same as described above with respect to shelving 16 and collars 24. Releasable locking engagement may be utilized to maintain the split sleeve 34 in its assembled position on the support post, as is well known.

The split collars of the present invention may be fabricated from ABS or nylon with a fiber filler, for example. Alternatively, the collars may be fabricated of metal, such as stainless steel, for example. Each split collar 18 includes an upwardly turned hook 40 extending away from the rear half 28 of the collar. As explained more fully below, shelving 14 is supported in place by interacting with the hooks 40 on the split collars.

Figure 4:
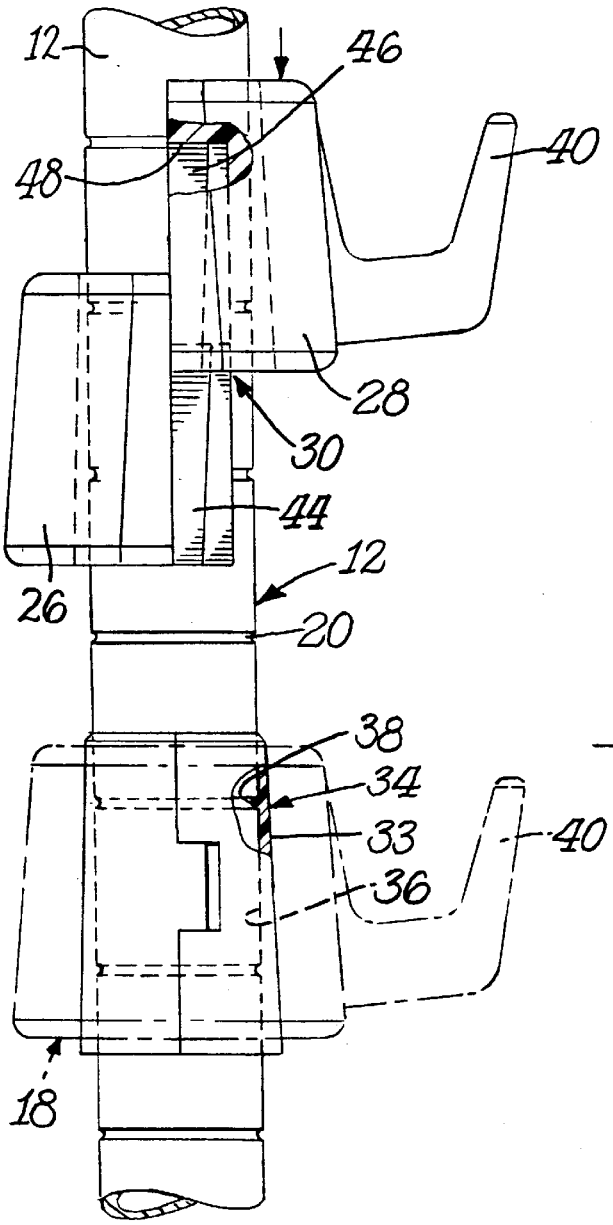
FIG. 4 is a side elevational view illustrating the split collar being assembled as well as the split collar fully assembled with a split sleeve between the collar and the support post.
Figure 5:
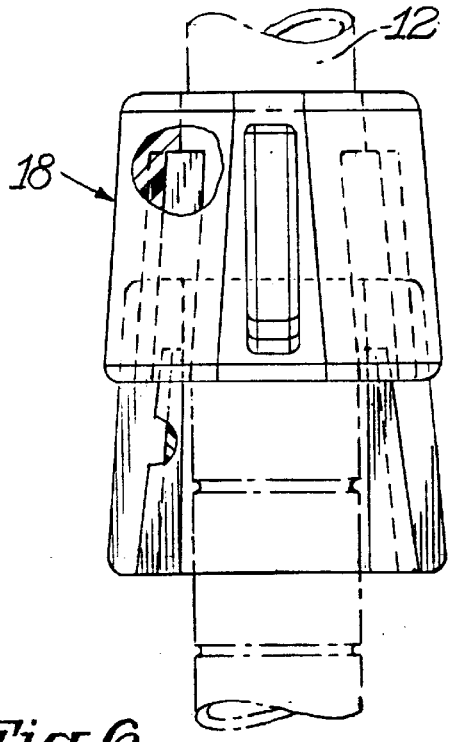
FIG. 5 is a rear elevational view illustrating the split collar halves sliding together.
Figure 6:
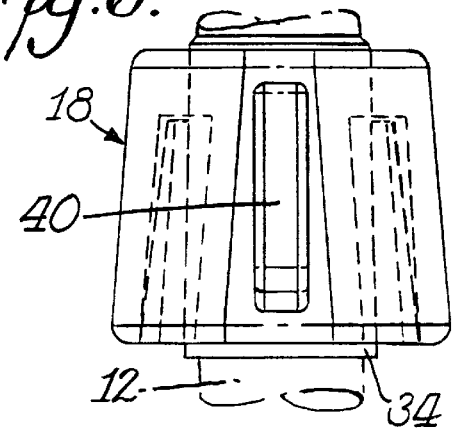
FIG. 6 is a rear elevational view illustrating the split collar completely assembled over a split sleeve and a corner support post.
Figure 10:
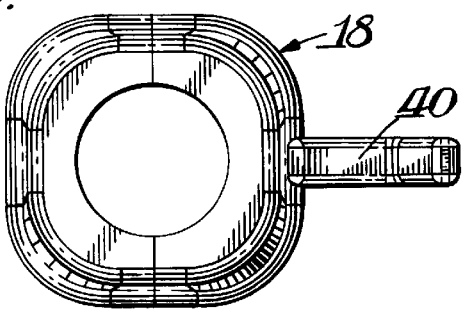
FIG. 10 is a top plan view of the split collar.
Figure 8:
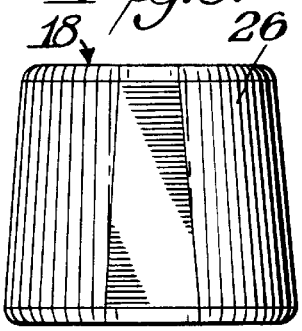
FIG. 8 is a front elevational view of the split collar.
Figure 7:
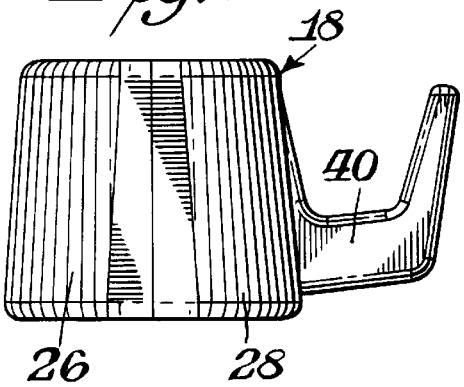
FIG. 7 is a right side elevational view of the split collar.
Figure 9:
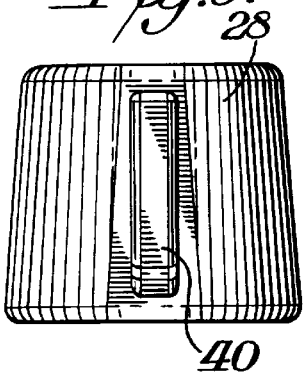
FIG. 9 is a rear elevational view of the split collar.
Figure 11:
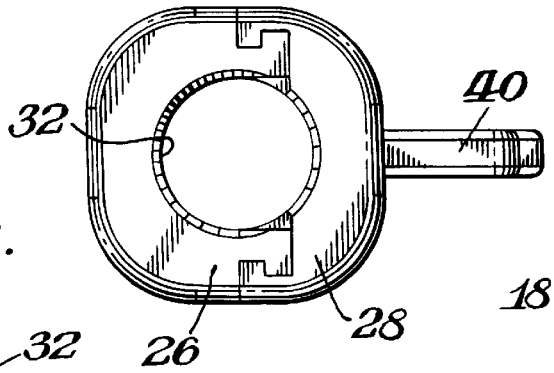
FIG. 11 is a bottom plan view of the split collar.
Figure 12:
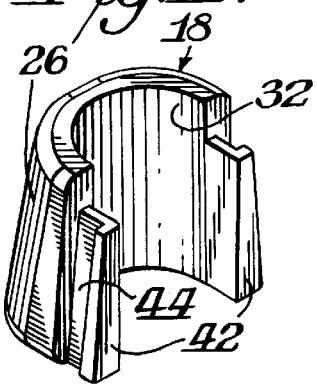
FIG. 12 is a perspective view of the front half of the split collar.
Figure 13:
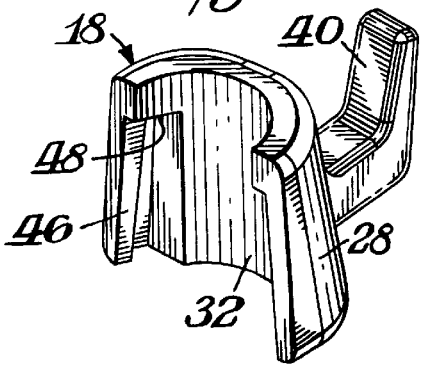
FIG. 13 is a perspective view of the rear half of the split collar.

The interconnecting structure 30 between the front and rear halves 26, 28, respectively, of the split collar is best shown in FIGS. 4, 12 and 13. Front half 26 includes lateral extensions 42 and each extension has an undercut locking groove 44. Groove 44 is slightly tapered and generally extent in a vertical direction. Rear half 28 of the split collar has an opposed pair of locking tongues 46 constructed and arranged for releasable locking engagement with the grooves 44 on the front half of the split collar. The tongues are slightly tapered and complement the taper of the grooves 44. Rear half 28 is simply positioned above front half 26 with the tongues 46 in engagement with the grooves 44. The two halves are urged together until the upper ends of the extensions 42 on the front half of the split collar contact stop structure 48 on the rear half. Each groove 44 tapers outwardly from top to bottom, and each tongue tapes inwardly from bottom to top to thereby produce a tight fit around split sleeve 34 and its associated support post 12.

In one embodiment of the present invention, the adjustable shelving assembly may include four corner support posts 12 with one convention shelf 16 at the upper end of the posts and a similar shelf at the lower end of the posts. When additional shelving 14 is desired, a split sleeve 34 and split collar 18 are releasably connected to each post with the hooks 40 of the split collar facing in an inward direction. Shelving 14 has a small corner recess 50 at each of its four corners to accommodate the split collars. Also, shelving 14 includes structure 52 at the recess 50 which rests on the hooks 40 to support shelving 14 in place.

Shelving 14 may be horizontally mounted or inclined, as shown best in FIGS. 1 and 2. Inclined assembly is the same as horizontal except that the split collars on the two front support posts 12 are positioned at a lower elevation with respect split collars on the rear posts. The outward extension of the hooks 40 enables inclined positioning of the shelves 14 when desired.

What is claimed is:

1. A split collar for releasably attaching shelving to vertical support posts, the collar comprising a front half and a rear half, vertically oriented interlocking structure between the collar halves for releasably locking the collar halves together, the collar having a frusto-conical interior surface, and only one upwardly extending shelf supporting hook on the split collar integral with one of the collar halves, the hook having a shelf support surface for receiving and supporting shelving, and the shelf support surface essentially consisting of a straight horizontally oriented surface.

2. A split collar for releasably attaching shelving to vertical support posts, the collar comprising a front half and a rear half, vertically oriented interlocking structure between the collar halves for releasably locking the collar halves together, the collar having a frusto-conical interior surface, and an upwardly extending shelf supporting hook integral with one of the collar halves, the hook having a shelf support surface for receiving and supporting shelving, and the shelf support surface essentially consisting of a straight horizontally oriented surface, and wherein the vertically oriented interlocking structure between the collar halves includes vertically oriented undercut grooves on one half and complementary vertically oriented tongues on the other half.

3. A split collar as in claim 2 wherein the front half includes the undercut grooves and the rear collar half includes the complementary tongues, and wherein the hook is integral with the rear collar half.

4. A split collar as in claim 1 in combination with a vertical support post and an interconnecting split sleeve between the collar and the post, the split sleeve having an interior surface releasably connected to the support post and an exterior surface having a frusto-conical configuration complementary to the interior frusto-conical surface of the split collar.

5. An adjustable shelving assembly comprising a plurality of vertically oriented support posts, at least one split collar releasably secured to each post, each split collar comprising a front half and a rear half with vertically oriented interlocking structure between the collar halves for releasably locking the collar halves together, each split collar having a frusto-conical interior surface, only one upwardly extending shelf supporting hook on each split collar integral with one of the collar halves, the hook having a shelf support surface for receiving and supporting shelving, the shelf support surface essentially consisting of a straight horizontally oriented surface, and shelving resting on the shelf support surface of each split collar to thereby connect the shelving to the support posts.

6. An adjustable shelving assembly comprising a plurality of vertically oriented support posts, at least one split collar releasably secured to each post, each split collar comprising a front half and a rear half with interlocking structure between the collar halves for releasably locking the collar halves together, each split collar having a frusto-conical interior surface, an upwardly extending shelf supporting hook on each split collar integral with one of the collar halves, the hook having a shelf support surface for receiving and supporting shelving, the shelf support surface essentially consisting of a straight horizontally oriented surface, and shelving resting on the shelf support surface of each split collar to thereby connect the shelving to the support posts, and wherein the interlocking structure between the collar halves includes vertically oriented undercut grooves on one half and complementary vertically oriented tongues on the other half.

7. An adjustable shelving assembly as in claim 6 wherein the front half includes the undercut grooves and the rear collar half includes the complementary tongues, and wherein the hook is integral with the rear collar half.

* * * * *

UNITED STATES PATENT AND TRADEMARK OFFICE

CERTIFICATE OF CORRECTION

PATENT NO. : 5,884,567

DATED : March 23,1999

INVENTOR(S) : William L. Bartz,Jr.

It is certified that error appears in the above-identified patent and that said Letters Patent is hereby corrected as shown below:

Column 1, line 14, "comer" should read -- corner --;
line 61, "feature" should read -- features --.

Column 2, line 41, "filly" should read -- fully --.

Column 3, line 30, "extent" should read -- extends --.

Signed and Sealed this

Twenty-seventh Day of July, 1999

*Attest:*

Q. TODD DICKINSON

*Attesting Officer*

*Acting Commissioner of Patents and Trademarks*